United States Patent [19]

Gallaway

[11] 4,425,051

[45] Jan. 10, 1984

[54] RESTORING SKID FRICTION TO WORN PAVEMENT SURFACES

[76] Inventor: Bob M. Gallaway, 2904 Par Dr., Bryan, Tex. 77801

[21] Appl. No.: 56,232

[22] Filed: Jul. 10, 1979

[51] Int. Cl.[3] ..... E01C 19/00

[52] U.S. Cl. ..... 404/72; 404/117

[58] Field of Search ..... 404/72, 19, 20, 117

[56] References Cited

U.S. PATENT DOCUMENTS

| | | | |
|---|---|---|---|
| 1,073,647 | 9/1913 | Walter | 404/19 X |
| 1,745,100 | 1/1930 | Johnston | 404/90 X |
| 2,010,025 | 8/1935 | Kirchner | 404/20 |
| 2,953,469 | 9/1960 | Fox | 404/20 X |
| 2,967,466 | 1/1961 | Shoemaker | 404/19 |
| 3,605,583 | 9/1971 | Keppler | 404/117 |
| 3,844,670 | 10/1974 | Perkins | 404/104 |
| 3,905,714 | 9/1975 | Perkins | 404/72 |
| 3,909,147 | 9/1975 | Takata | 404/117 |

*Primary Examiner*—Nile C. Byers, Jr.
*Attorney, Agent, or Firm*—Laurence R. Brown

[57] ABSTRACT

This invention discloses a simple, fast, inexpensive method of restoring skid friction to worn asphalt or concrete pavement surfaces. This is achieved by traversing the pavement with a smooth heavy cylindrical vibratory roller of the type used in earth compactors at a speed and vibration amplitude less than that it takes to materially chip away the surface structure. The result is a material improvement in skid friction.

4 Claims, 5 Drawing Figures

FIG. 1
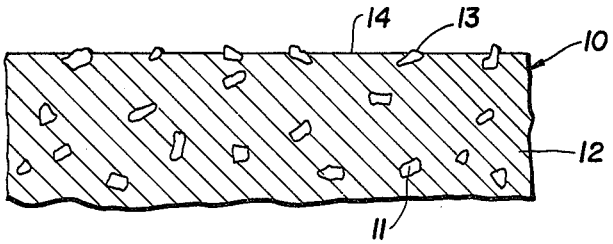
FIG. 2
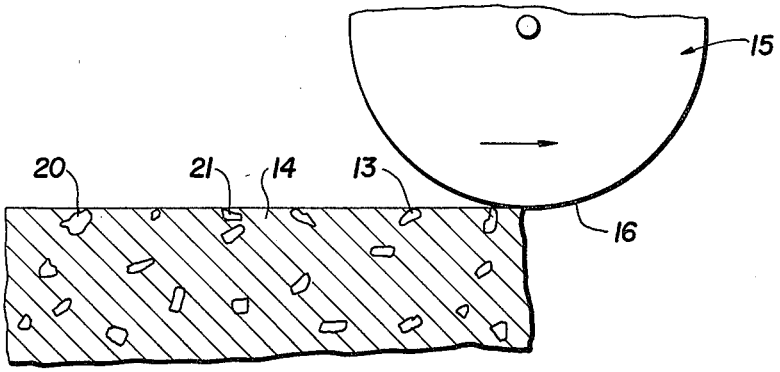
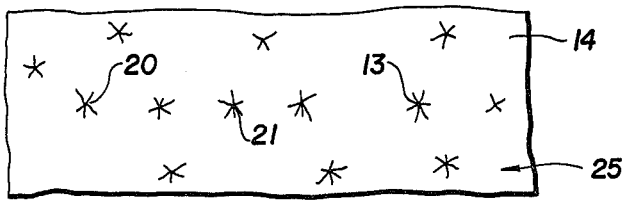
FIG. 3
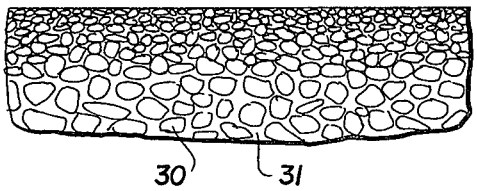
FIG. 4
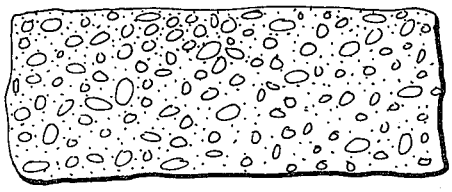
FIG. 5

RESTORING SKID FRICTION TO WORN PAVEMENT SURFACES

TECHNICAL FIELD

This invention relates to road maintenance, and more particularly it relates to the processing of worn road pavement surfaces to restore skid friction thereto.

BACKGROUND ART

Modern highways need be made and maintained under very strict standards. In particular, the surface must conform to skid friction requirements as set up for example under ASTM E274 procedures with an ASTM E501 skid test tire.

However, highways meeting acceptable standards become worn reducing the skid friction. There have been no known acceptable prior art techniques adaptable to restoring of these worn surfaces.

One problem, for example, in restoring skid friction surfaces with concrete surfaces is the potential erosion from freeze-thaw conditions if the surface seal is substantially disturbed or chipped during a roughening process.

Another problem is the inconvenience, time and cost of restoring surfaces on an existing highway where traffic need be detoured or the highway incapacitated during heavy traffic conditions.

A further problem is the large variety of concrete and asphalt surface conditions that need be resurfaced, where different roadway surfaces may need custom attention because of different concrete or aggregate conditions.

Still a further problem is meeting the required highway specifications after roughening treatment for restoring greater skid friction, which may vary from one jurisdiction to another.

Typical prior art attempts have not solved the foregoing problems. Thus, related U.S. patents are referenced as follows:

J. W. Shoemaker et al., U.S. Pat. No. 2,967,466—Jan. 10, 1961, forces dissolvable pellets into an asphalt surface to make skid pockets.

F. E. Johnston et al., U.S. Pat. No. 1,745,100—Jan. 28, 1930, uses a set of staggered machine driven hammers which impact a concrete surface with pointed ends to chip the surface away.

G. E. Perkins, U.S. Pat. No. 3,844,670—Oct. 29, 1974, and 3,905,714—Sept. 16, 1975, use a set of sharp pointed teeth on a rotary drum surface to chip the concrete highway surface away, sweeps away the residue and deposits a new concrete layer on the chipped portion.

It is a general object of this invention to improve the status of the art in restoring skid friction surfacing to worn pavement surfaces.

It is an object of this invention to produce improved skid friction surfaces to roadways worn smooth without significant removal of surface material.

It is another object of this invention to restore skid friction surfaces to roadways quickly, economically and with minimal interruption of traffic.

It is another object of this invention to restore skid friction surfaces to roadways constructed of various materials within a range of specifications so that the restored surfaces will meet required specifications.

BRIEF DISCLOSURE OF THE INVENTION

In accordance with this invention the surface of an asphalt or concrete roadway is treated by contact with a smooth surface, preferably a rotating heavy drum that can be conveyed down the highway surface by a mobile engine, to substantially exert an equal force over the entire surface. The drum is vibrated at a frequency in the order of above 1,000 cycles per minute and the amplitude of vibration, weight of the drum and speed of rotation are selected for the particular concrete or asphalt roadway surface to improve the skid friction of the surface without removal of significant surface materials. Thus, the aggregates at or near the surface are fractured or rearranged without significant chipping to restore the skid friction without drastic surface deterioration, chipping or introduction of roadway fractures of the magnitude that could cause a change of surface specifications or accelerated deterioration of the surface with weather and winter conditioning.

BRIEF DESCRIPTION OF THE DRAWINGS

Further objects, features and advantages of the invention will be found throughout the following more detailed specification, with reference to the accompanying drawing, wherein:

FIG. 1 is an elevation section view schematic sketch of a typical piece of concrete pavement before processing;

FIGS. 2 and 3 are schematic sketches respectively in elevation section and plan view of the concrete pavement after processing in accordance with this invention to increase skid resistance; and FIGS. 4 and 5 are respectively schematic sketches in elevation section and plan view of a typical piece of asphalt pavement to be processed in accordance with the teachings of this invention.

DETAILED DESCRIPTION OF A PREFERRED EMBODIMENT

With reference to FIG. 1, a typical section of concrete pavement 10 has aggregate particles 11 dispersed in a cement binder 12 throughout the concrete. In general smaller aggregate particles 13 are found closer to the top surface 14 of the pavement. The surface 14 of the pavement 10 when made into a road surface is given a roughening treatment to produce a proper skid friction meeting the particular specifications of the various jurisdictions.

However, after use the surface 14 of the pavement 10 is worn smoother so that the skid friction deteriorates with aggregate particles 13 at the surface becoming rounded and the concrete 12 portion of the surface itself being worn and smoothened from its original roughness.

This is rectified and improved skid friction is restored as schematically shown in FIG. 2 by this invention through a heavy vibratory steel drum roller 15 with a flat cylindrical surface 16 passing over the concrete surface 14 to contact the entire surface at a speed and vibration amplitude sufficient to restore an acceptable skid friction coefficient without any significant removal of surface concrete or deep fractures that could cause pavement deterioration. The speed, drum weight, and vibration amplitude can be readily established experimentally, since it varies for different concrete (or asphalt) surfaces depending on condition, age, hardness, type of aggregate, etc. Preferably the drum 15 is of the type providing vibrations at variable amplitudes at a frequency in the order of 1,000 cycles per minute or greater. This type of mobile roller for example can be the "Ranger 2-84" model self propelled vibratory compactor available from Ray Go Inc., Minneapolis, Minn. 55445.

Experimental use of the technique of this invention has shown a significant restoration of skid friction on smooth worn highway concrete and asphalt surfaces with little removal of surface materials. With a tractor propelled two drum array having drums of diameter approximately 1.5 m and length 2.13 m at a speed approximating 2 KM/Hr vibrating at about 1200 v.p.m. in a low amplitude mode of less than 10,000 Kg. per drum, it was found that surfaces with a skid coefficient of $SN_{40}=43\pm$ were increased in a range from $SN_{40}=55$ to $SN_{40}=71$, as tested by ASTM E274 procedures with the ASTM E501 skid test tire.

It is clear that the mere rolling of a flat cylindrical steel vibratory drum compactor over a pavement surface to restore skid friction is not only an unexpectedly simple solution but it provides a resurfacing technique at low cost, high speed and minimum interruption to traffic.

While it is not entirely clear what causes the major contribution to improved skid friction of pavement surfaces, the probable theory of operation with concrete pavements is explained with reference to FIGS. 1 to 3.

When the roller 15 traverses the surface 14 of the concrete, as shown in FIG. 2, it exerts a force on the surface and the aggregate particles 13, 20, 21, etc. at or near the surface. This force apparently causes minute fissures, breaks or disruptions of the surface 25 as exemplified in FIG. 3 at 13, 20, 21, etc. Preferably these resulting fractures of the surface are not (with some few exceptions) enough to accumulate any significant degree of dust or residue on the surface, and thus the roughening is limited to the close vicinity of the surface and is not apt to cause any significant later deterioration because of weather conditions, freezing-thawing, etc. Any such results at the surface will in effect serve to further improve skid friction, without causing catastrophic failure or out-of-specification degrading. The extent of pressure, force and energy applied to the surface is therefore controlled so that little visible dust and chipping is observed but enough to fracture and roughen the surface in the vicinity of surface aggregate. This is easily controlled by traverse speed, vibration frequency and vibration amplitude when using the foregoing equipment for example, but varies from one concrete pavement to the next because of different aggregates, hardnesses, impurities, etc.

As depicted by the exemplary asphalt type pavement of FIGS. 4 and 5, the same process is effective but apparently operates in a different manner. In this case the aggregate particles 30 are more densely packed with an asphalt type binder 31 interspersed therebetween. This binder is more plastic and tends to deform to accommodate surface aggregate particles moved about by the above described process. This apparently creates minute disturbances, fissures and repositioned possibly less smooth aggregate surfaces to achieve the improved skid friction characteristic.

With the asphalt surfaces, there is no preheating required, and for best results the processing is done when the asphalt surface is below a temperature which unduly softens the plastic binding materials.

In any event, it is clearly confirmed from experimental data that the process significantly increases the skid friction of both concrete and asphalt pavement surfaces with such minute damage that there is no serious deterioration as would be provided by chipping or indentation of the surfaces. Also the process is quickly done with standard available commercial equipment that is used in roadway processing for other purposes and requires no extra expensive tooling or special machinery. Thus, the art is unexpectedly advanced by providing a simplified, low cost solution to an outstanding problem not satisfactorily achieved by prior art techniques.

INDUSTRIAL APPLICATION

This invention provides for restoring skid friction to worn smooth asphalt or concrete pavement surfaces by contacting the entire surface area with a vibratory rolling smooth cylindrical compactor surface to produce minute fractures or fissures without removing any significant dust or residue from the surface. Thus, a simple, effective, low cost resurfacing method is afforded using available equipment, with a minimal inconvenience to traffic conditions while resurfacing.

What is claimed is:

1. The method of restoring skid friction to worn pavement surfaces comprising the steps of rolling a heavy cylindrical drum over the pavement surface to contact the pavement surface with substantially the entire drum surface thereby to exert a force on those aggregate particles in and near the pavement surface and vibrating the drum while rolling on said surface at a frequency above about 1,000 vibrations per minute at an amplitude and rolling speed causing said aggregate to fracture and be rearranged at or near the surface to produce an increased skid friction without substantial chipping and removal of surface materials.

2. The method as defined in claim 1 wherein the pavement surface is asphalt or the like and this pavement surface rolled by said drum without application of external heat to soften the asphalt surface for the rolling.

3. The method as defined in claim 1 wherein the pavement surface is concrete or the like and the vibration amplitude and rolling speed is selected in a range that avoids any significant accumulation of fractured concrete particles on the surface.

4. The method of restoring skid resistance to pavement surfaces worn smooth by fracturing and rearranging aggregates at or near the entire surface area of the pavement with a vibrating tool passed over and contacting the pavement surface over substantially its entire surface with an evenly distributed force on the surface in an energy range resulting in an increase in skid friction and insubstantial removal of the pavement surface.

* * * * *